United States Patent [19]

Samsing

[11] 4,153,162

[45] May 8, 1979

[54] PRODUCT DISPLAY CARD

[75] Inventor: Rolf A. Samsing, Braintree, Mass.

[73] Assignee: The Gillette Company, Boston, Mass.

[21] Appl. No.: 868,845

[22] Filed: Jan. 12, 1978

[51] Int. Cl.[2] ..... B65D 73/00; B65D 85/00; A45D 27/24

[52] U.S. Cl. ..... 206/476; 206/372; 206/462; 206/486; 206/488

[58] Field of Search ..... 30/34 R, 90, 153; 206/45.14, 45.31, 349, 372, 461–463, 471, 476, 485–486, 488, 491, 526, 562–563, 588–589, 806; 211/39, 60 R, 60 T, 66, 72–73; 248/152; 229/87 H

[56] References Cited

U.S. PATENT DOCUMENTS

| | | | |
|---|---|---|---|
| 1,670,204 | 5/1928 | Moore | 206/476 X |
| 2,491,423 | 12/1949 | Snyder | 206/463 X |
| 2,990,059 | 6/1961 | Hitt | 206/486 X |
| 3,322,268 | 5/1967 | Larkin | 206/488 X |
| 3,417,866 | 12/1968 | Omer | 206/488 X |
| 3,586,161 | 6/1971 | Fong et al. | 206/372 |

FOREIGN PATENT DOCUMENTS

| | | | |
|---|---|---|---|
| 1204801 | 1/1960 | France | 206/462 |
| 619154 | 3/1949 | United Kingdom | 229/87 H |
| 1004981 | 9/1965 | United Kingdom | 206/462 |

*Primary Examiner*—Davis T. Moorhead

*Attorney, Agent, or Firm*—Richard A. Wise; Mandel E. Slater

[57] ABSTRACT

A product display card is described, which is particularly adapted to hold one or more elongate articles in organized close-packed array. The card is preferably formed from a one-piece paperboard blank, and includes a front panel with cutouts for opposite end portions of the articles to extend therethrough, and a pair of rear panels joined to the front panel at opposite edges thereof adjacent the end portions of the articles. The rear panels have cutouts generally aligned with the front panel cutouts, but dimensioned to retain the end portions of the articles at the front side of the card, while intermediate portions of the articles are retained at the rear side of the card. A feature of the product display card is that at least one end of an article to be displayed thereon and the front panel cutout corresponding to that end extends substantially to an edge of the finished card.

11 Claims, 5 Drawing Figures

PRODUCT DISPLAY CARD

BACKGROUND OF THE INVENTION

1. Field of the Invention

This invention relates to product display cards, and is directed more particularly to product display cards having a display article mounted therethrough.

2. Description of the Prior Art

A particularly advantageous and popular form of packaging for various products sold in retail trade, especially for products of moderate or small dimensions, is the display card, to which the product is attached or secured by some suitable means, usually in a manner such that the product is readily visible for easy examination by prospective purchasers. A common feature of such display cards is the provision of punched-out portions, allowing the cards to be conveniently presented for sale on pegged self-service display racks such as are in wide use in supermarkets, general merchandise stores, and the like.

An example of a product sold in this manner is the disposable razor. This example is referred to from time to time throughout the specification, though it is to be understood that the invention is broadly applicable to the packaging of numerous types of products presenting similar considerations in package design.

The great number of different products and variations of products being sold in retail establishments such as those mentioned above puts display space at a premium, and accordingly it is incumbent upon the package designer to make the most efficient use of the limited space available, i.e., to provide for the display of the greatest amount of product in the smallest possible space. This is particularly true for products to be displayed at checkout counters, where display space is severely limited.

A related consideration is based upon the fact that great numbers of existing "standard" display racks are currently in use in thousands of selling locations. In order that these existing display racks be usable for new products, the display cards must meet certain dimensional requirements. In the above-mentioned example of disposable razors and like products, a great many of the existing pegged display racks are so designed as to accept product display cards not wider than 4⅜ inches and frequently no more than 4⅜ inches square. For comparison a typical disposable razor in wide distribution is about 4 inches in overall length.

Mention may also be made of certain other factors in the design of an optimal package. For the sake of economy it is desirable to use the minimum quantity of packaging materials; for products sold in great quantities, even a small saving in materials per package can amount to considerable savings overall. At the same time attention should be given to adaptability of the display card to automatic machine loading of the product thereon.

One type of display card in common use is the blister package, which is well known in the art. The product (or products) is set into a clear plastic bubble, or blister, formed to a shape generally complementary to the shape of the packaged article; and a card, usually paperboard, is heat sealed to the blister. While package size constraints can be met (assuming the product itself meets the size constraints), for many products the expense of complete enclosure in a protective plastic bubble is not necessary; and, in any event, when the configuration of the product provides a nesting capability, the advantage of that capability is generally not available with the blister package.

Another related type of package known in the art involves a flexible pouch, with or without a backing card, with the products loosely arrayed in the pouch. Because the products can often tumble about in the pouch and cause it to bulge, the number of such pouch packages that can be hung on a peg of given length is limited. As before the advantage if the product has a nesting capability is not realized.

Now considering further those products that do have a nesting capability, it will be appreciated that a greater quantity of product can be stored and displayed in a given space. It is known in the art that in card-mounting such products, the nesting capability may be enjoyed if the product is mounted through the card, the card in effect more or less bisecting the product and not getting in the way when the front portion of one unit of the product nests into the complementary-shaped rear portion of a second unit of the product on an adjacent card.

When the product has this nesting capability and in addition size constraints are imposed, as in the aforementioned example of 4-inch disposable razors to be mounted on a 4⅜ inch square display card, it has been difficult to design a card that combines both the most efficient use of space on the card and the capability of automatic machine loading. Referring again to the disposable razor example, an efficient use of card space involves arranging the razors straight across the card in alternating head-to-toe close-packed array. For this purpose a suitable card could have parallel front and rear panels formed from a suitably cut and scored blank folding back on itself to form the two panels, the cutout portions of the panels suitably dimensioned to receive and retain the razor through the card.

With this arrangement automatic machine loading of the card is not practical, because in the example, cutouts in the card long enough to accept the product dropped in by machine would have to be so long as to run substantially to the edges of the blank, thereby weakening it and so adversely affecting its structural integrity that the finished display card could not be formed properly. The alternative is to make the cutout shorter, leaving sufficient uncut paperboard at the ends for the blank to remain structurally sound, the shorter cutout allowing the products to be inserted through at an angle, then straightened and brought to final position with portions of the product extending to either side of the finished display card. This complex motion of inserting at an angle and subsequently straightening or repositioning does not readily lend itself to machine operations.

SUMMARY OF THE INVENTION

Accordingly it is an object of the invention to provide a product display card adapted to have mounted therethrough articles having a dimension substantially approximating the dimension of the display card.

Another object of the invention is to provide a product display card of the type described which is readily adaptable to automatic machine loading.

Still another object of the invention is to provide a product display card of the type described which requires a minimal quantity of expensive packaging materials.

With the above and other objects in view a feature of the present invention is the provision of a product display card formed from a one-piece blank and adapted to hold therethrough one or more elongate articles in organized array, the articles having a configuration such that opposite end portions can extend to a front side of the card, while intermediate portions of the articles are retained at the rear side of the card. The card has a front panel provided with, for each article, a pair of front panel cutouts through which the opposite end portions of the article extend to the front side of the card. At least one of the cutouts and the end portion of the article therethrough extend substantially to an edge of the front panel. A pair of rear panels are foldably joined to the front panel at opposite edges thereof adjacent the end portions of the article and are adapted to be secured in parallel relationship to the front panel. The rear panels have rear panel cutouts generally aligned with the front panel cutouts, but dimensioned so that the end portions are retained at the front side of the card, while the intermediate portion is retained at the rear side of the card.

As indicated above, this type of display card is particularly advantageous when the product to be packaged is of such dimension that it must of necessity extend substantially to an edge of the card. With the card formed from a blank having a pair of rear panels foldably joined at opposite ends of the front panel, it becomes practical to extend a product-receiving cutout right to the end of the front panel, to where a rear panel is joined, while the blank remains structurally sound because the corresponding rear panel coutout is not cut to the edge, leaving an uncut portion wide enough at least to provide for structural integrity of the blank and retention of the corresponding end of the article at the front side of the finished display card.

In a preferred embodiment of the invention the displayed article has a flanged portion secured thereto and retained between the front and rear panels of the display card, in order to hold the article more securely in place. Where the article is a disposable razor, for example, having no integral flange as part of the displayed article, the flange may be part of an overcap secured to the head of the razor to protect the blade edges until the product is used.

In additional preferred embodiments of the invention the combined width of the rear panels may be less than the width of the front panel, by eliminating excess material at the middle of the rear side of the card. This economy of packaging materials is made possible by designing the product display card as a double-fold card, i.e., one having a pair of rear panels folding from opposite ends, rather than as a single-fold card with a fold at one end and a rear panel extending across to the other end of the card. The portions of the rear panel(s) near the ends of the card serve to hold the products in place, and it is not required that these panels extend far enough to meet; by narrowing them in the double-fold card configuration, their essential function is retained, and substantial savings in raw materials can be realized.

It is also to be appreciated that while the product display card of the invention is particularly adapted to situations where a plurality of articles are to be packaged in minimal space, various advantageous features, such as easy assembly and economy of materials, may be enjoyed when packaging only a single article in the manner described.

The above and other features of the invention, including novel details of construction and combinations of parts, are more particularly described below with reference to the accompanying drawing, and pointed out in the claims. It is to be understood that the particular arrangement embodying the invention is shown by illustration only and not as a limitation of the invention, the principles and features of which may be employed in numerous embodiments without departing from the scope of the invention.

BRIEF DESCRIPTION OF THE DRAWING

Reference is made to the accompanying drawing in which is shown an illustrative embodiment of the invention, from which its novel features and advantages will be apparent.

DESCRIPTION OF A PREFERRED EMBODIMENT

Figure 1:
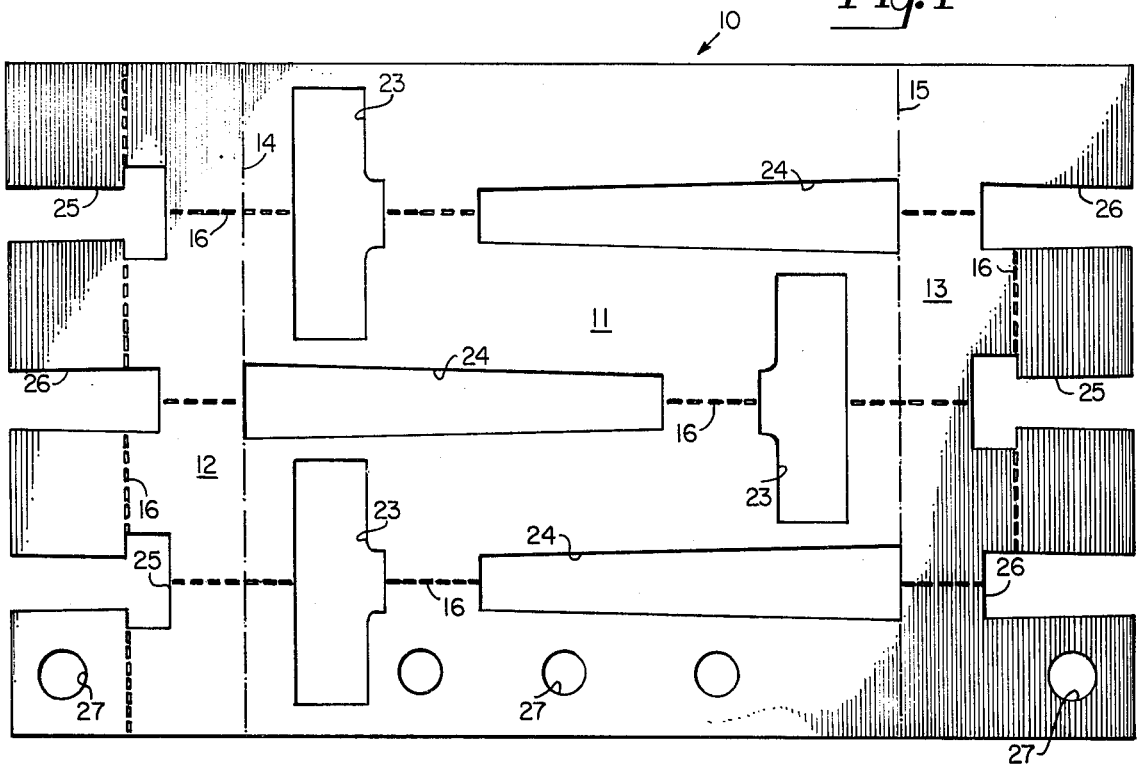
FIG. 1 is a plan view of a blank for a product display card illustrative of the invention.

Referring to the drawing and in particular to FIG. 1, it will be seen that the illustrative display card is formed from a paperboard blank 10 divided into a front panel 11 and two rear panels 12, 13 by fold lines 14, 15. A number of perforated tear lines 16 are provided to facilitate later opening of the package for removal of the product secured therein.

For the purposes of illustration the blank shown in the drawing is designed to be formed into a product display card 4⅜ inches square for holding therethrough three disposable razors 17 (FIG. 2), substantially T-shaped in configuration, each about 4 inches in length, arranged in alternating head-to-toe close-packed array, in order that three can fit on a card of the given dimension. Each razor consists of a head portion 18 (with the shaving edges) and a handle 19, the latter terminating at a toe 20. A clear plastic protective overcap 21 is releasably secured to the head of each razor, each overcap including a flange 22, which aids in securing each razor to the card, as will presently be shown.

For each razor, front panel 11 is provided with a complementary-shaped head cutout 23 and separate handle cutout 24, the handle cutout terminating at one of the fold lines 14, 15, as the case may be.

Rear panels 12, 13 are provided with head cutouts 25 and handle cutouts 26, positioned to be in general alignment with (after the blank is folded along fold lines 14, 15) front panel head cutouts 23 and handle cutouts 24, respectively. As can be seen from the drawing, the rear panel cutouts are open at the edges of the blank and are separated from their corresponding front panel cutouts by an expanse of uninterrupted paperboard (except for portions of the tear lines 16), which lends strength to the blank. Since the rear panels are relatively narrow, the blank is not excessively weakened, because cutouts 25 and 26, even though open at the edges of the blank, are short. A series of punched holes 27 is provided to allow the finished product display card to be hung on a pegged display rack.

In forming the product display card with the razors mounted therethrough, blank 10 is supported at uncut portions of the front panel, and the disposable razors 17 are placed into the complementary-shaped front panel cutouts 23, 24. Head cutouts 23 are so dimensioned relative to razor head 18 and overcap 21 as to allow the latter components to drop through, while retaining flange 22. Handle cutouts 24 are dimensioned so that handle 19 can drop through, toe 20 clearing fold lines 14, 15, as the case may be, with a little room to spare. It will be appreciated that this involves merely dropping the razors in place, which can be done easily by high-speed automatic machinery.

Figure 2:
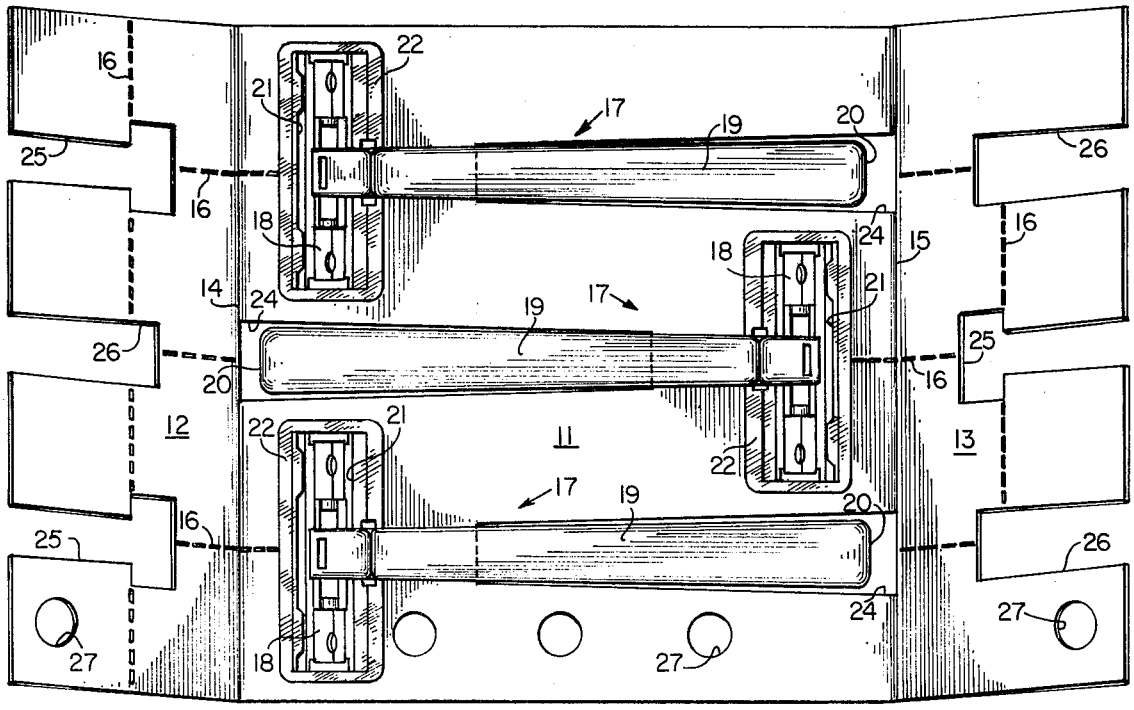
FIG. 2 is a view similar to FIG. 1, but showing articles received on the front panel of the card and the rear panels in an intermediate position as they are being folded to form the product display card.
Figure 3:
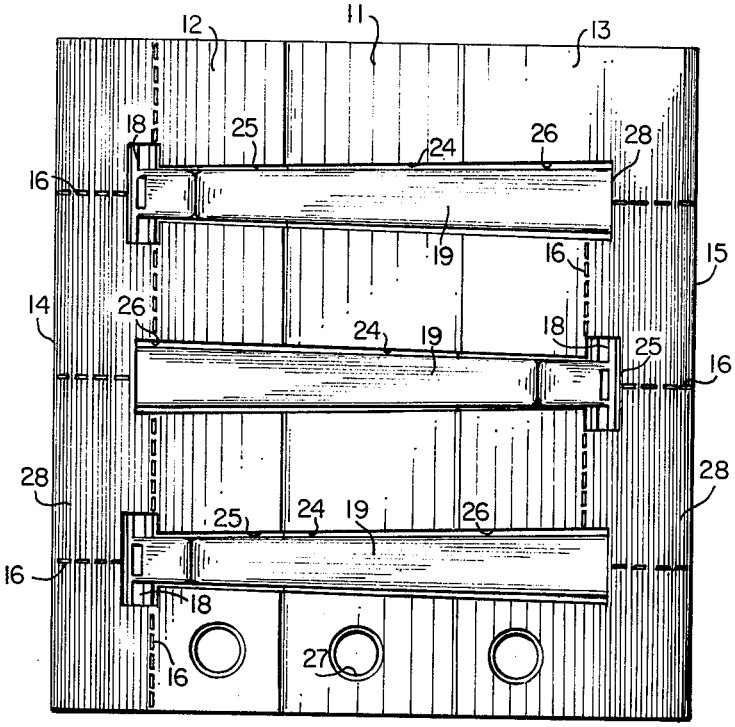
FIG. 3 is a rear elevational view of the completed product display card, showing completion of the assembly operation of FIG. 2.
Figure 4:
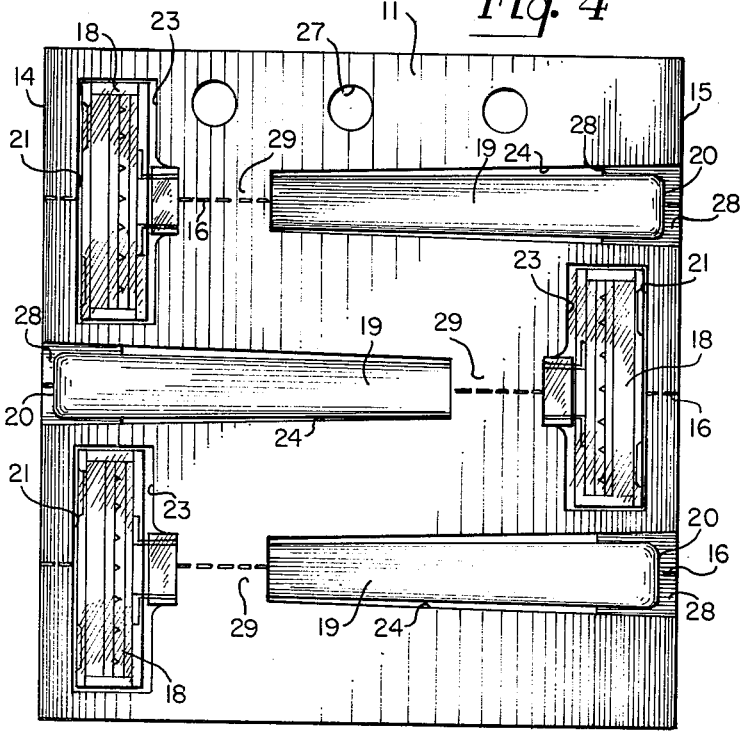
FIG. 4 is a front elevational view of the completed card.

As best seen in FIG. 2, rear panels 12, 13 are bent up about fold lines 14, 15 and then folded back against front panel 11, where they are secured in place, in parallel relationship to the front panel, such as by glueing, heat sealing, or the like, completing the product display card (FIGS. 3 and 4). It will be seen that in folding over the rear panels, rear-panel head cutouts 25 are so dimensioned that handle 19 can pass through while razor head 18 and its associated overcap 21 are retained through the front panel at the front side of the card. Similarly, since rear panel handle cutouts 26 do not extend close to fold lines 14, 15, the folded over rear panels retain the portion of handle 19 which is adjacent toe 20 through the front panel at the front side of the card. The parts of the rear panels performing this function are indicated at 28 in FIGS. 3 and 4. At the same time the uncut portions of the front panel remaining between head and handle cutouts 23 and 24, respectively, indicated at 29 in FIG. 4, retain a portion of the handle completely behind the card at the rear side thereof.

With the flanged portion of overcap 21 sealed between the front and rear panels, the disposable razors of the above-described example are very securely locked in place on the card. However it is to be recognized that the flanged member is not essential, since retention of the disposable razors in the positions shown follows from the fact that razor head 18 is trapped at the front side of the card in any event, and reducing dimensional tolerances and clearances can further contribute to a secure arrangement.

Figure 5:
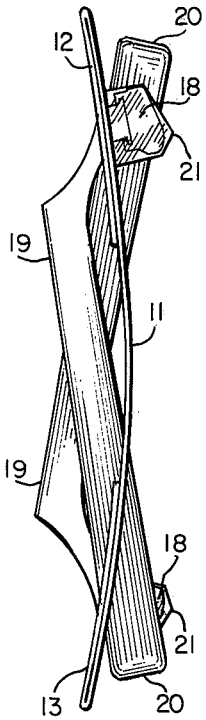
FIG. 5 is a view of the completed card as seen from the top of FIG. 3 or the bottom of FIG. 4.

In FIG. 3 it it readily seen that there is little to be gained in the way of more secure retention of the displayed articles by extending the rear panels until they meet (or even overlap), other than to have a double thick card over its entire area, which is not really necessary. As mentioned previously, eliminating the unnecessary material allows the card to be formed from a smaller blank, resulting in reduced cost of materials. In FIG. 5 it will be seen that as a consequence of having the card only one layer thick at its central portion, the card can take on a gentle curvature. However no disadvantage results from this slight curvature, and in the case of the disposable razors shown, which are shaped to have a nesting capability, the razors on adjacent product display cards will still nest snugly, unaffected by the curvature.

While various aspect of the invention have been illustrated by the foregoing detailed embodiment, it will be understood that various substitutions of equivalents may be made without departing from the spirit and scope of the invention.

What is claimed is:

1. A product display card having front and rear sides and formed from a one-piece blank, said card holding therethrough one or more generally elongate articles in organized array, each article including opposite end portions and an intermediate portion connecting said end portions and so configured that said end portions are at said front side while said intermediate portion is at said rear side; said card comprising:

a front panel provided with, corresponding to each said article, a pair of front panel cutouts and an uncut portion extending therebetween, each said end portion projecting through one of said front panel cutouts to said front side, at least one said cutout and said end portion projecting therethrough extending substantially to an edge of said front panel; and a pair of rear panels foldably joined to said front panel at opposite edges thereof adjacent said end portions and secured in parallel relationship to said front panel, said rear panels provided with rear panel cutouts generally aligned with said front panel cutouts and retaining said end portions at said front side, said uncut portion retaining said intermediate portion of said article at said rear side of said card.

2. The invention of claim 1, in which said end portions consist of head and toe portions, and said organized array comprises an alternating head-to-toe arrangement.

3. The invention of claim 2, wherein said articles are close-packed.

4. A product display card as defined in claim 1, in which a member with a flange is secured to said article, said flange being retained between said front panel and said rear panel.

5. A product display card as defined in claim 1, wherein the combined width of said rear panels is less than the width of said front panel.

6. The invention of claim 1, wherein said articles are substantially T-shaped.

7. The invention of claim 1, wherein said articles are razors.

8. The invention of claim 1, in which said display card is of paperboard.

9. A product display card as defined in claim 1, wherein said end portions consist of head and toe portions, said organized array comprises a close-packed alternating head-to-toe arrangement, and a member with a flange is secured to said head portion, said flange being retained between said front panel and one of said rear panels.

10. The invention of claim 9, wherein said articles are substantially T-shaped.

11. A product display card having front and rear sides and formed from a one-piece blank, said card adapted to hold therethrough one or more generally elongate articles in organized array, said card comprising:

a front panel forming portion provided with, for each said article, a pair of front panel cutouts and an uncut portion extending therebetween, said front panel cutouts adapted to receive opposite end portions of said articles projecting therethrough to said front side, at least one of said pair of front panel cutouts extending substantially to an edge of said front panel forming portion; and a pair of rear panel forming portions foldably joined to said front panel at opposite edges thereof adjacent said front panel cutouts and adapted to be secured in parallel relationship to said front panel, said rear panels provided with rear panel cutouts generally aligned with said front panel cutouts when said front and rear panels are secured in said parallel relationship and dimensioned to retain said opposite end portions of said articles at said front side, said uncut portion adapted to retain a portion of said articles intermediate said end portions at said rear side of said card.

* * * * *